US006300762B1

(12) United States Patent
Thomas, Jr. et al.

(10) Patent No.: US 6,300,762 B1
(45) **Date of Patent: *Oct. 9, 2001**

(54) USE OF POLYARYLETHERKETONE-TYPE THERMOPLASTICS IN A PRODUCTION WELL

(75) Inventors: Stanley R. Thomas, Jr., Houston; Brian Clark, Sugar Land, both of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/363,597

(22) Filed: Jul. 29, 1999

Related U.S. Application Data

(63) Continuation-in-part of application No. 09/026,218, filed on Feb. 19, 1998, now Pat. No. 6,084,052.

(51) Int. Cl.[7] ..... G01V 3/10

(52) U.S. Cl. ..... 324/339; 324/338

(58) Field of Search ..... 324/339, 338; 528/125, 220, 425; 156/160, 175, 272.2; 175/50; 166/243, 385; 428/364

(56) References Cited

U.S. PATENT DOCUMENTS

| | | | | |
|---|---|---|---|---|
| 4,662,887 | * | 5/1987 | Turner et al. | 623/16 |
| 4,714,509 | | 12/1987 | Gruber | 156/272.2 |
| 4,739,325 | * | 4/1988 | Macleod | 340/854.4 |
| 4,747,988 | * | 5/1988 | Deeg | 264/211.17 |
| 4,816,556 | | 3/1989 | Gay et al. | 528/176 |
| 5,160,561 | | 11/1992 | Gruber | 156/175 |
| 5,160,568 | | 11/1992 | Gruber | 156/430 |
| 5,563,512 | * | 10/1996 | Mumby | 324/339 |
| 5,642,051 | | 6/1997 | Babour et al. | 324/357 |
| 6,084,052 | * | 7/2000 | Aufdermarsh et al. | 528/125 |

FOREIGN PATENT DOCUMENTS

| | | |
|---|---|---|
| 0 307 215 | 3/1989 | (EP) . |
| 0 463 611 | 1/1992 | (EP) . |
| 0 505 260 A2 | 9/1992 | (EP) . |
| 0 656 460 A2 | 6/1995 | (EP) . |
| 0 860 584 | 8/1998 | (EP) . |
| WO 97/12166 | 4/1997 | (WO) . |

OTHER PUBLICATIONS

RM Archibald & RA Bulstra, "Use of Glass Reinforced Epoxy Resin Tubing in Oman," SPE 9636, presented at the Middle East Oil Technical Conf. Of the Soc. of Petroleum Engineers, (Mar. 9–12, 1981).

* cited by examiner

*Primary Examiner*—Safet Metjahic
*Assistant Examiner*—S. Zaveri
(74) *Attorney, Agent, or Firm*—John J. Ryberg; Victor H. Segura

(57) ABSTRACT

The present invention relates generally to the use of polyaryletherketone-based thermoplastic materials in high pressure, high temperature, production logging applications. A polyaryletherketone resin bonded with glass fibers is formed into a housing for formation evaluation sensors permanently located downhole. The housing is constructed by any of the following processes: filament winding, fiber placement, or compression molding or injection molding. When used in a production well, the housing encloses the formation evaluation sensors and protects the sensors from borehole fluids. Housing properties can be modified with changes in materials added to the resin in order for the housing to function as casing or coiled tubing. This would allow wireline or logging-while-drilling conveyed sensors passing through the casing or coiled tubing to sense the formation and borehole fluid properties.

18 Claims, 4 Drawing Sheets

USE OF POLYARYLETHERKETONE-TYPE THERMOPLASTICS IN A PRODUCTION WELL

CROSS-REFERENCES

This application is a continuation-in-part of U.S. Pat. application Ser. No. 09/026,218 filed on Feb. 19, 1998, now U.S. Pat. No. 6,084,052.

BACKGROUND OF THE INVENTION

This invention concerns the use of polyaryletherketone-based thermoplastic materials in downhole logging applications. By way of background, downhole logging tools are exposed to difficult environmental conditions. The average depth of wells drilled each year becomes deeper and deeper, both on land and offshore. As the wells become deeper, the operating pressures and temperatures become higher. The open hole involves the drilling of a borehole through subsurface formations. After the drill bit has passed through each strata, it leaves a fairly rough, abrasive surface along the borehole wall. Wall spalling can also create sharp edges. While the abrasive nature is reduced by the accumulation of mud cake on the borehole wall, the repeated travel of a logging tool through the borehole still produces abrasive wear to the borehole wall. In addition, a deviated borehole will further lead to abrasive wear on the logging tools.

Drilled wells present an extremely hostile environment. Boreholes are often rugose and abrasive. Drilling muds, which are used to facilitate drilling, contain chemical additives that may degrade non-metallic materials. They are highly caustic with a pH ranging as high as 12.5. Other well fluids may include salt water, crude oil, carbon dioxide, and hydrogen sulfide, all of which are corrosive to many materials.

Downhole conditions progressively become more hostile at greater depths. At depths of 5,000 to 8,000 meters, bottom hole temperatures (BHT) of 260° C. and pressures of 170 Mpa are often encountered. This exacerbates degradation of exposed logging tool materials.

These deep well conditions of high pressure and high temperature (hereinafter, "HPHT") damage the external or exposed logging tool components. Internal electronics need to be protected from heat and external housing need to be upgraded. The most vulnerable materials are the plastic and composite materials that are exposed to caustic drilling mud and other corrosive borehole fluids. Some tools, such as those making electrical induction, resistivity, and magnetic resonance measurements, require these non-conductive, non-magnetic materials of construction in order to function properly. This requires materials that are essentially transparent to electromagnetic radiation and have a magnetic permeability of one.

Ceramics generally are too brittle, i.e., a sharp impact may fracture the ceramic. Conventional plastics, such as epoxies and phenolics, perform adequately in conditions up to about 180° C. and 100 Mpa. Under more extreme conditions, however, they fail prematurely. Many alternative materials have been evaluated and rejected for various reasons. For example, polyimides, polyethermide ("ULTEM"), and polyamideimide ("TORLON") are well known for their excellent durability at high temperature. These materials fail in borehole fluids because the -imid and -amide linkages are subject to rapid hydrolytic degradation at high pH. Polyphenylene sulfide is water resistant but its crystalline melting point, 260° C. is too low for HPHT applications.

SUMMARY OF THE INVENTION

The above disadvantages of the prior art are overcome by means of the subject invention for use of a class of material, polyaryletherketones, that meets the demanding thermal and chemical requirements for downhole applications. This material has the desired high pressure, high temperature (HPHT) performance characteristics, and is also impervious to chemical attack by borehole and formation fluids. A composite material utilizing polyaryletherketones is formed into a shell for use with a downhole logging tool or in a production well. This shell provides structural rigidity and strength at HPHT conditions even in the presence of chemically active materials. Moreover, the shell is tough and resilient so that abrasive contact is considerably reduced during movement in the borehole so it does not damage or otherwise harm items enclosed by the material. The shell is substantially transparent to signal transmission from the logging tool and response from the formation. With this shell, formation evaluation sensors that utilize acoustic, nuclear, resistivity, and electromagnetic technology may be permanently located downhole, positioned in the completion string, and/or in the borehole casing. Properties of the shell can be modified with changes in materials added to the resin in order for the shell to function as casing or coiled tubing. This allows wireline or logging-while-drilling conveyed sensors passing through the casing or coiled tubing to sense the formation and borehole fluid properties.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

In the drawings.

DETAILED DESCRIPTION OF THE PREFERRED EMBODIMENT

Figure 1:
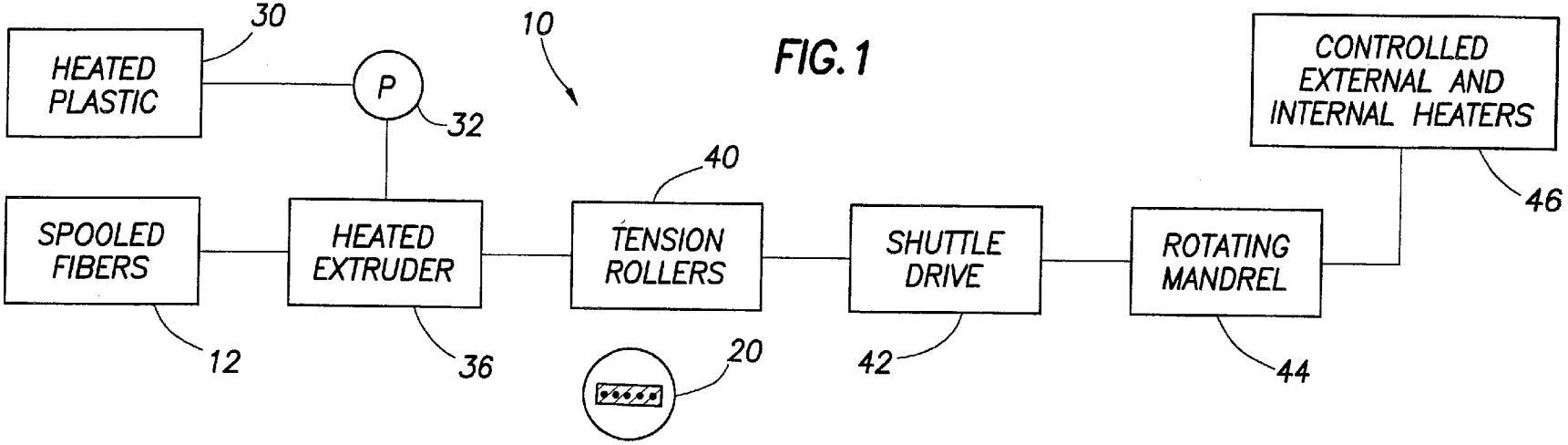
FIG. 1 is a block diagram schematic showing a sequence of manufacturing steps for converting flexible yarn and impregnating resin into a towpreg wrapped on a rotating mandrel for forming an elongate cylindrical housing for an induction logging tool wherein the towpreg is wrapped around the mandrel to form the completed shell.

Referring to FIG. 1, a method of forming the preferred polyaryletherketone resin is set forth. As a preliminary step to making the multiple ply, multiple layer composite into an elongate tubular shell, a resin impregnated, fiber reinforced member called towpreg is formed. FIG. 1 illustrates a towpreg manufacturing and winding line 10. Several replicated spools of fibers 12 are located so that they direct elongate strands which align the several fibers to form the disclosed towpreg 20. The towpreg 20 is formed to a specified width and thickness. The thickness is typically in the range of about 0.008" to about 0.02". The width is up to about 0.25". In general terms, it is extruded to form a rectangular cross-section. The shape is defined by a die which provides the requisite rectangular cross-sectional form.

The fibers are preferably a high temperature material provided by Owens Corning Fiberglass and are known as S2 fiberglass. The fiberglass is a high-strength, magnesium aluminosilicate glass. The glass fibers have a diameter ranging between about 10 and about 40 microns. They are preferably continuous-filaments, i.e., they are extremely long. Where they are grouped as a number of individual fibers making up an interlaced supply, the individual fibers have finite length but when interlaced, the collective length is substantially indefinite. Several sources of fibers are spooled to provided controllable tension and a desired level of prestress in them.

U.S. Pat. No. 4,320,224 discloses the class of polyaryletherketones. Structurally, they are semi-crystalline, thermoplastic resins composed of the following repeat units:

$$—C_6H_4—,—O—,—C(O)—$$

in which the —(O)— and —C(O)— units are separated by at least one $—C_6H_4—$unit.

The '224 patent describes PEEK, one type of thermoplastic resin manufactured by Victrex USA, Inc. of West Chester, Pa. Its repeat unit is as follows:

$$[C_6H_4C(O)\ C_6H_4O\ C_6H_4O]_n$$

where n is about 100.

Cytec Fiberite markets another type of thermoplastic resin known as PEKK. It has the following repeat unit:

$$[C_6H_4O\ C_6H_4C(O)\ C_6H_4C(O)]_n$$

where n is about 100.

BASF commercialized another type of thermoplastic resin known as ULTRAPEK. It has the following repeat unit:

$$[C_6H_4O\ C_6H_4C(O)\ C_6H_4O\ C_6H_4O\ C_6H_4C(O)\ C_6H_4C(O)]_n$$

where n is about 50.

Preferably, the shell of the subject invention is comprised of PEKK, however, the shell may be comprises of any of the aforementioned resins. In the preferred embodiment of the invention, fiberglass embedded resin is wound to the desired size and may be later machined if required.

Carbon black, up to about 2%, is added to the selected resin. Carbon black assists in the winding operation by enhancing heat absorption. It also reduces UV degradation in the finished product. Electrical properties are not degraded by a small amount of carbon granules. The selected resin is supplied at a specified viscosity and heated to an elevated temperature that is sufficient to effectively impregnate the fibers 12. More specifically, this temperature is in the range of at least about 650° F. and the most effective temperature is about 700° F. or slightly there above. The finished product is in the range of about 33% to 43% by weight of resin. The remaining portion is made up of the fiber content 12.

Figure 3:
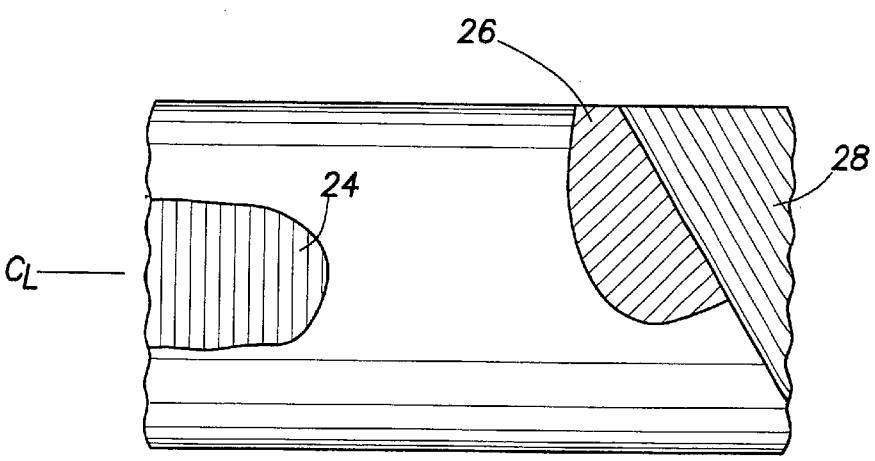
FIG. 3 is a side view of a completed induction logging tool shell with portions broken away to illustrate multiple plies which form the shell and provide strength for it.
Figure 2:
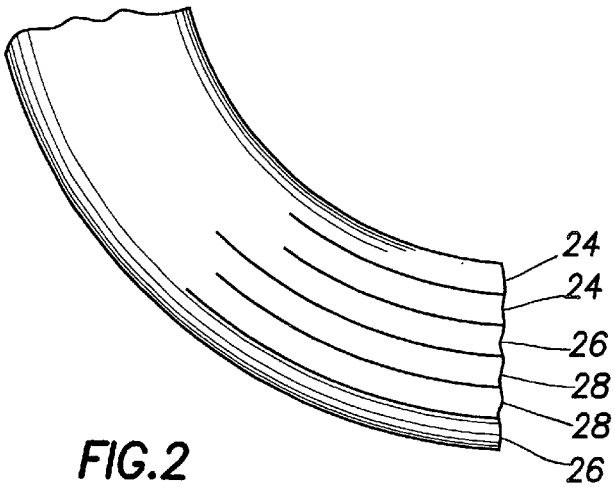
FIG. 2 is an enlarged end view of a completed shell showing a portion of the wall and showing how it is formed of multiple layers of towpreg.

The selected resin 30 is delivered by a pump 32 along with the fibers 12 to a heated extruder 36. After leaving the extruder, the towpreg is cooled then collected on a spool. The towpreg 20, from one or more spools, is guided over tension rollers 40 to a shuttle drive 42 for winding on a rotating mandrel 44. Several adjacent heaters 46 apply heat externally and internally as needed to enable the tensioned member 20 to form a "unitary" member from multiple windings in multiple plies. FIGS. 2 and 3 show different plies around a mandrel shaping an elongate cylinder. This includes one or more bottom plies 24 having no bias angle, and plies 26 and 28 with bias angles in opposite directions. The outer ply 26 has essentially no bias angle.

1. Thermoplastic Composite Construction

There exists several different processes for the construction of continuous fiber reinforced composite articles. These include filament winding, compression molding of stacked sheets, fiber placement, and resin transfer molding. For polyaryletherketone resins, such as the ones described herein, the most preferred method is filament winding. The first step is to impregnate S2 fiberglass tow with the resin as described for example in U. S. Pat. No. 4,549,920. The tow comprises a plurality of filaments, the filaments having a diameter preferably up to 24 microns. The tensioned tow is passed continuously through a heated nip at which point it is spread and molten resin is injected so as to substantially completely wet all the filaments with resin. The impregnated tow, called towpreg, has the form of flat tape. It is then traversely wound on a rotating mandrel from a traversing carriage as described, for example, in U.S. Pat. No. 5,160,561. Consolidation is achieved by appropriate heating to melt each successive ply so that it fuses to the previous ply before cooling and solidifying. The resulting monolithic structure has all the properties required of a shell for a downhole logging tool or for use in a production well.

Plies are added at an angle (from the axis of the mandrel) which can vary between 0 and 90°. Mechanical properties in the x, y, and z directions depend on the angular construction which is therefore specified according to engineering requirements. For a logging tool, a shell of the subject invention typically will have a tubular shape with diameters ranging from 2–20 cm, a wall thickness from 0.2–2 cm, and a length up to six meters. The filament winding process described above is well suited to produce tubular shapes having these dimensions. These dimensions could increase substantially when composites are designed into a production well.

2. Property and Test Data

Prior to the subject invention, shells rated to 260° C. were comprised of a thermoset phenolic resin reinforced with fiberglass fabric. Shells were fabricated by impregnating woven glass fabric with a phenolic resin to give a prepreg. The prepreg was wrapped around a mandrel to the desired thickness then cured under heat and pressure. The resulting thermoset composite shells were extremely unreliable; sometime they performed as designated, but more often, they failed by cracking.

Shells were certified by immersing them for a few hours in a high pressure well in water at 270° C. and 179 Mpa hydrostatic pressure. A high percentage of shells failed during a single excursion in a test well. Shells that survived the well test often failed after a single well-logging job. Failures were traced to internal defects caused by the shrinkage of the resin during curing. The thermoplastic composite shells of this invention do not have this disadvantage and therefore do not fail in well tests.

Another way to compare composite shells is to test their properties before and after well tests. To that end, a method was developed to measure ring flexural properties. One-inch rings sliced from shells were compressed diametrically between opposing flat platens of a test machine until failure. From the stress/strain curve, it is possible to calculate the modulus and strength of rings using published formulas.

A series of tests were conducted in which rings were exposed in water or oil at temperatures ranging from 176° C. to 260° C. and pressures to 179 Mpa for periods up to 12 hours. Representative rings were subjected to the ring flexural tests before and after exposure. Phenolic/fiberglass rings showed excessive losses in ring flexural strength. In a typical test, flexural strength declined from 140 Mpa to 78.6 Mpa after only one hour at 232° C. and one hour at 260° C.

For comparison, filament-wound rings made of fiberglass-reinforced PEKK resin were tested, but under more severe conditions. After six hours in water at 270° C. and 145 Mpa pressure the ring flexural strength was 206 Mpa and the flexural modulus was 36 Gpa.

3. Molded Components

Random lengths of chopped fiberglass are randomly mixed with the preferred resin, and are injected at appropriate temperature and pressure by an injection molding machine into a mold to define a shaped sub. As before, up to about 2% of carbon black distributed throughout the resin is permissible. The fibers are more or less randomly oriented. The fibers provide significant structural integrity and modify the CTE somewhat. They may comprise about 30% or 40% by weight of the mixture. After injection molding, a component is provided having desirable characteristics in a high temperature, high-pressure downhole environment.

4. Logging Tool Construction

Figure 4:
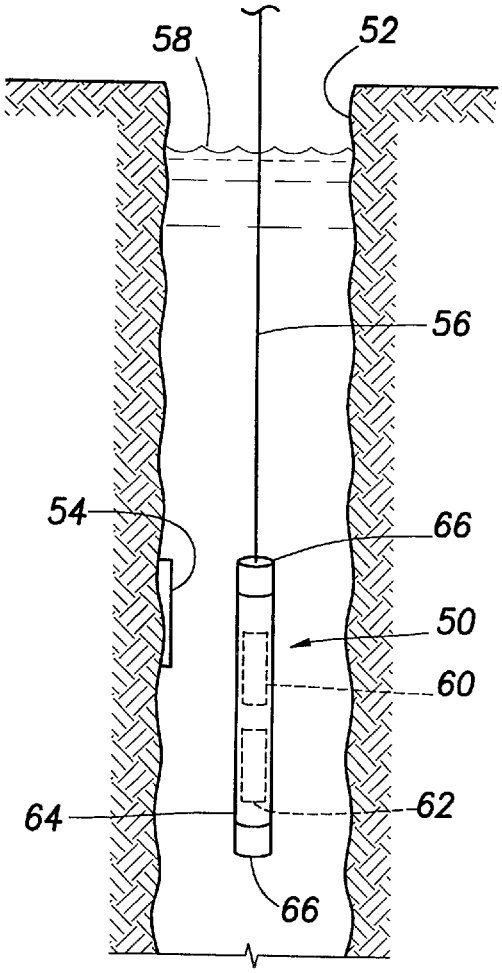
FIG. 4 shows a wireline supported logging tool.
Figure 5:
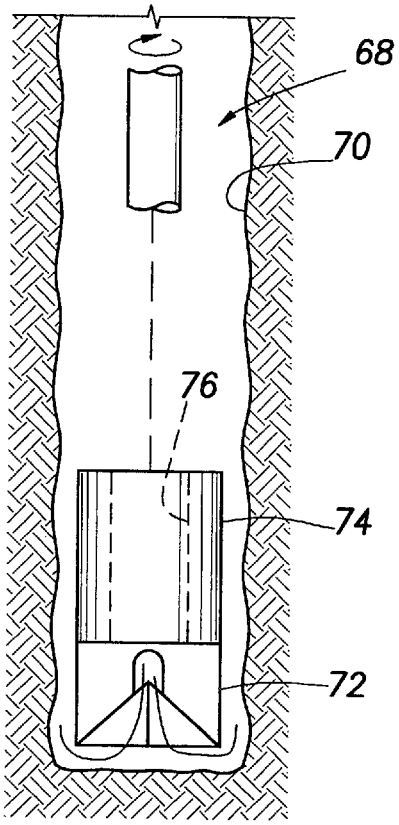
FIG. 5 shows a drill stem supported logging-while drilling tool.

FIG. 4 illustrates a wireline supported logging tool in an open hole filled with borehole fluid and FIG. 5 depicts a logging tool appended to a drill stem. As will be understood in both circumstances, vertical boreholes are illustrated, however, these logging tools may be used in deviated or horizontal boreholes. By gravity, the logging tool 50 is lowered into the borehole 52. While part of the well may be cased, it has been omitted at the portion of the well adjacent to the logging tool 50 to illustrate the typical circumstances. Mud cake 54 will build up on the rugose borehole wall which somewhat reduces the abrasive nature of the borehole. Nevertheless, the rugose condition of the wall abrades the exposed surfaces of the logging tool 50 suspended on the wireline 56. In this context, the tool may drag against the sidewall. Based on the weight of the tool, the angle of the well, and other factors which are highly variant, some abrasive damage will accumulate. In general terms, the tool is lowered through the borehole fluid to the desired depth. FIG. 4 has been simplified but provides a representation of the environment in which the logging tool is exposed to high pressures and high temperatures in the present of highly caustic borehole fluid, i.e., $H_2S$ entrained in the borehole fluid.

Still referring to FIG. 4, the logging tool 50 incorporates some type of formation irradiation device 60, and a matched responsive sensor 62. The device 60 can be one or more coils in an array forming an induced EMF field in the adjacent formation that typically is denoted as a transmitter coil (meaning one or more). The sensor 62, in that instance, is denoted as a receiver coil (one or more) and thus the coil system makes inductive logging measurements in the formations. Another example is a neutron generator that transmits neutrons into the formation and the sensor 62 would then be a radiation detector, such as a NaI detector. Without regard to the particular irradiation device 60, the matched sensor receives and responds appropriately and forms a logging signal useful in determining the nature of the formations along the borehole. The logging tool incorporates the shell 64 that is mounted between a pair of end located subs 66. The shell is formed in the manner disclosed above to thereby house the operative components of the logging tool. The hollow shell is mounted on appropriate end located subs 66 that are made by injection molding using the preferred resins of this disclosure. The surfaces of the shell 64 and the subs 66 are formed of the preferred resin fabricated as set forth above.

Referring to FIG. 5, a logging-while-drilling system is illustrated. The drill stem 68 includes an appropriate length of drill pipe extending from a kelly at the surface with rotation imparted in the illustrated direction. At the lower end of the drill stem, a drill bit 72 advances the hole in response to rotation. Several drill collars 74 are incorporated. The drill collars are pipe joints with thick walls to enhance stiffness and weight. Mud is pumped down through the drill stem, flowing through the internal passage 76 in the drill collar 74, out through the drill bit 72, and returned to the surface in the annular space on the exterior of the drill stem. The drill stem includes one or more conventional drill collars 74 wherein at least one drill collar includes a logging-while-drilling (LWD) apparatus.

Figure 6:
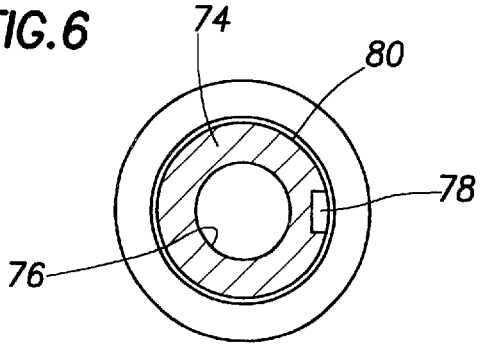
FIG. 6 is a sectional view of the tool of FIG. 5.

Referring to FIG. 6, the drill collar 74 is provided with a chamber 78 to enclose a measuring instrument. The measuring instrument can be the same instruments incorporated in device 60 of FIG. 4. More specifically, some type of irradiation device and sensor are mounted in chamber 78. There may be a plurality of chambers 78 located along the drill collar 74. The chambers are located so that they do not materially weaken the drill collar. In general terms, the radiation is directed outwardly in the form of a beam or fully encircles the borehole. An induction logging tool exemplifies a measuring system extending radially outwardly around the borehole. In any event, the operative equipment for the measuring system is mounted and protected in the chamber 78, and the sleeve 80 is positioned around that. The sleeve 80 is transparent to the radiation, including EMF at any desired frequency. In addition, it isolates the chamber 78 from the borehole fluids. The fabricated cylindrical housing 80 is constructed in accordance with this disclosure. It has the advantages of operating at significant HPHT and yet is transparent to the EMF transmitted into the formations.

Figure 7:
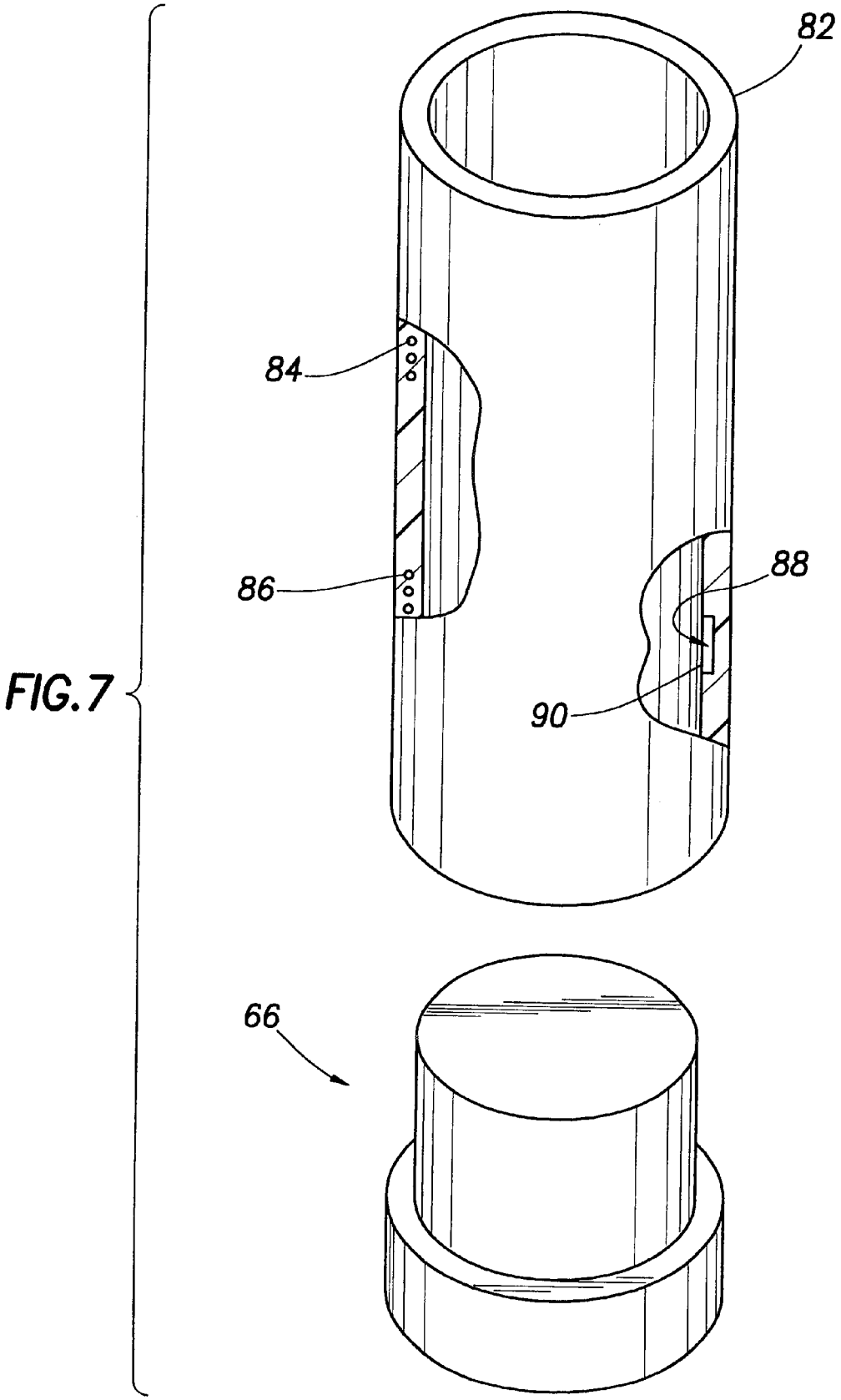
FIG. 7 is an isometric view through a sleeve showing a coil array supported by the sleeve.

Referring to FIG. 7, a modified shell 82 and end located sub 66 is illustrated. A portion of the wall has been broken away to show the shell construction. The shell or sleeve 82 is constructed with a first coil 84 wound within the wall thickness. A second coil 86, spaced from coil 84, integrally forms a part of the wall. As representative dimensions, the wall might be about 0.50" in thickness and encloses one or more turns of the coils 84 and 86. By way of example, coil 84 may comprise a transmitter coil and coil 86 may comprise a receiver coil for an induction logging array. As required, the coils may be partially or wholly embedded in the wall. The wall may include a recessed area 88 in which a sensor 90, responsive to the EMF or other irradiation triggered response, is mounted. Accordingly, the sensor 90 can be on the inside surface, recessed or flush mounted (as illustrated), and can also protrude above the surface of the wall. Both integrally formed sensors can be incorporated as well as those which are mounted after manufacture. The sensor construction shown in FIG. 7 may be employed in a wireline tool or an LWD tool.

5. Production Well Application

Figure 8:
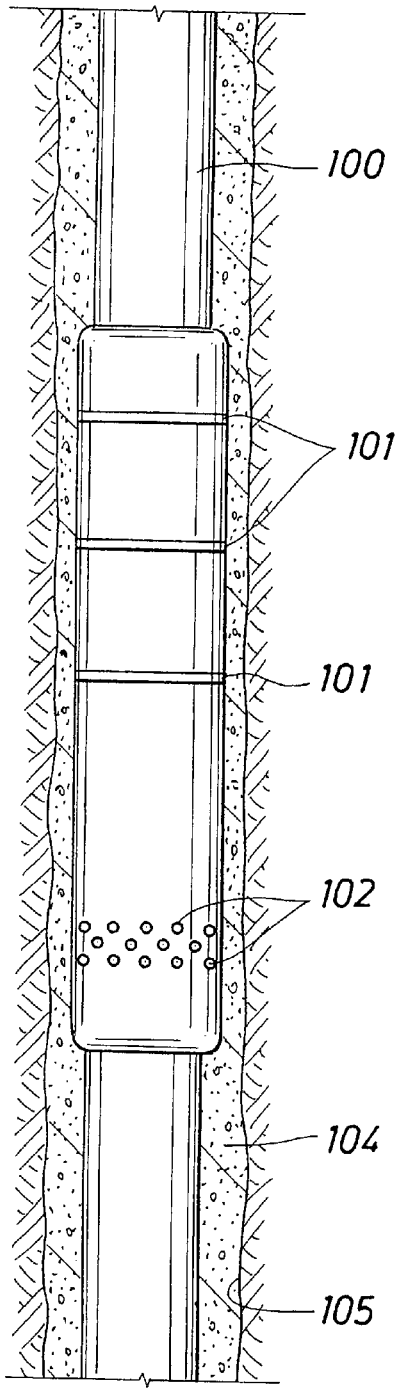
FIG. 8 illustrates a production well where the shell of the subject invention is bonded to a metal casing; and, FIG. 9 illustrates a production well where the shell of the subject invention is bonded to coiled tubing.

A shell formed in the manner disclosed above may be permanently positioned in a production well. See U.S. Pat. No. 5,642,051 that describes a downhole control system for a production well that permanently locates formation evaluation sensors downhole throughout production operations. Referring to FIG. 8, in the subject invention, the shell 103 is bonded onto a rigid, metal casing 100 to electrically isolate the casing from the formation and external fluids. Formation evaluation sensors are integrated with shell 103. These sensors may be partially or wholly embedded in the shell's wall or mounted to a surface of the shell. By way of example, these sensors may include rings 101 of conductive material (which, for instance, could be PEKK towpreg with carbon rather than glass filament) or a plurality of button electrodes 102 fixed permanently to the shell 103. Cement 104 is injected, in a manner known to those skilled in the art, into the annular space between the borehole 105 and the adjacent surface, shell 103 or casing 100.

Those skilled in the art, with benefit of this disclosure, will appreciate that the shell 103 of the subject invention has sufficient strength and thickness to function as the casing in a production well. Due to the material properties of the shell, it would enable the use of other downhole monitoring tools, such as nuclear devices, which would either be obstructed by or obscured by the metal casing 100 while making measurements of the subsurface formations or formation fluids. When the shell 103 is installed as the casing, carbon black, carbon filaments, glass, metallic powders, and various other materials may be added to the resin to adjust the electrical properties of the shell 103. In a preferred embodiment of the invention, shell 103 preferably has an electrical conductivity between 0.01 s/m to 10 s/m.

Figure 9:
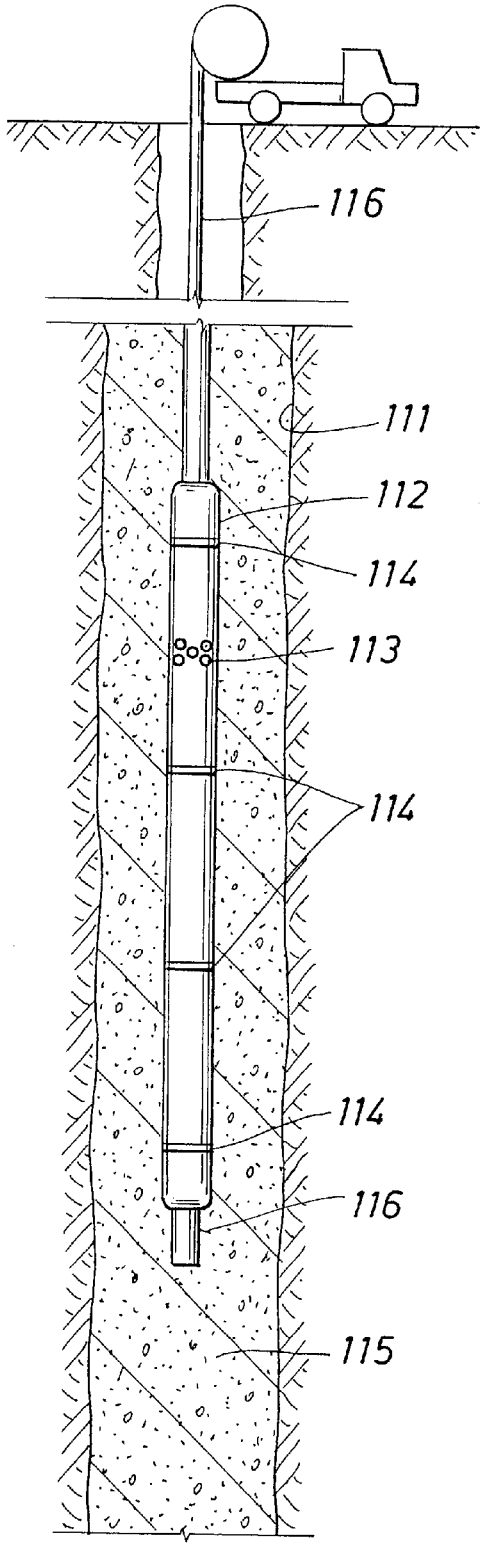

Referring to FIG. 9, in an alternate embodiment, the shell 112 is bonded onto coiled tubing 116. Formation evaluation sensors are integrated with shell 112. These sensors may be partially or wholly embedded in the shell's wall or mounted to a surface of the shell. By way of example, these sensors may include rings 114 of conductive material or a plurality of button electrodes 113 fixed permanently to the shell 112. Cement 115 is injected, in a manner known to those skilled in the art, into the annular space between the borehole 111 and the adjacent surface, shell 112 or coiled tubing 116. Similar to shell 103, the composite shell 112 could function as coiled tubing alone as well.

What is claimed is:

1. An apparatus for monitoring a formation surrounding a borehole in a production well, comprising: at least one sensor permanently located downhole for sensing a formation and/or a borehole fluid parameter; and, a housing that protects the sensor, the housing comprises a shell of polyaryletherketone thermoplastic resin.

2. The apparatus of claim 1 wherein said resin is a linearomatic polymer having the following repeat units:

$$—C_6H_4—,—O—,—C(O)—$$

in which —O— (ether) and —C(O)— (ketone) units are separated by at least one $—C_6H_4—$(arylene) unit.

3. The apparatus of claim 2 wherein said shell is a fiber reinforced composite including an elongate cylindrical fiber sleeve.

4. The apparatus of claim 3 including multiple plies of said fiber in said resin wherein said plies have specified angular bias positions.

5. The apparatus of claim 4 wherein said shell comprises a specified wall thickness of said resin; and said fibers are fiberglass.

6. The apparatus of claim 2 wherein a material which enhances heat absorption and reduces UV degradation of said shell is added to said resin.

7. The apparatus of claim 6 wherein the material is carbon black.

8. The apparatus of claim 1 wherein said shell is attached to a casing.

9. The apparatus of claim 1 wherein said shell is attached to coiled tubing.

10. The apparatus of claim 1 further comprising a casing comprised of polyaryletherketone thermoplastic resin.

11. The apparatus of claim 1 further comprising coiled tubing comprised of polyaryletherketone thermoplastic resin.

12. The apparatus of claim 1 wherein said sensor comprises a conductive fiber reinforced composite and polyaryletherketone thermoplastic resin.

13. The apparatus of claim 10 wherein said sensor comprises a conductive fiber reinforced composite and polyaryletherketone thermoplastic resin and said casing is non-conductive.

14. The apparatus of claim 11 wherein said sensor comprises a conductive fiber reinforced composite and polyaryletherketone thermoplastic resin and said coiled tubing is non-conductive.

15. The apparatus of claim 13 wherein a material that enhances the conductivity of said casing is added to said resin.

16. The apparatus of claim 14 wherein a material that enhances the conductivity of said coiled tubing is added to said resin.

17. An apparatus for placement in a borehole traversing an earth formation, comprising a casing formed from a composite material utilizing polyaryletherketone thermoplastic resin.

18. An apparatus for placement in a borehole traversing an earth formation, comprising a coiled tubing formed from a composite material utilizing polyaryletherketone thermoplastic resin.

* * * * *